US008881918B2

(12) United States Patent
Nally et al.

(10) Patent No.: US 8,881,918 B2
(45) Date of Patent: Nov. 11, 2014

(54) HORSESHOE GAME CADDY

(71) Applicant: Eastpoint Sports Ltd., LLC, Whippany, NJ (US)

(72) Inventors: Michael J. Nally, Whippany, NJ (US); Adam B. Abramson, Oxford, NJ (US); James P. Burns, Cranford, NJ (US)

(73) Assignee: Eastpoint Sports Ltd., LLC, Whippany, NJ (US)

( * ) Notice: Subject to any disclaimer, the term of this patent is extended or adjusted under 35 U.S.C. 154(b) by 1 day.

(21) Appl. No.: 13/781,253

(22) Filed: Feb. 28, 2013

(65) Prior Publication Data

US 2014/0239587 A1 Aug. 28, 2014

(51) Int. Cl.

| | |
|---|---|
| ***A47F 7/00*** | (2006.01) |
| ***A63B 67/06*** | (2006.01) |
| *A47B 43/00* | (2006.01) |
| *A47F 5/14* | (2006.01) |
| *A47B 9/00* | (2006.01) |
| *F16M 11/00* | (2006.01) |
| *B62B 1/00* | (2006.01) |
| *A63B 63/00* | (2006.01) |
| *B65D 69/00* | (2006.01) |
| *A63B 65/00* | (2006.01) |

(52) U.S. Cl.

CPC ..... *A63B 67/06* (2013.01)

USPC ..... 211/85.7; 211/194; 211/182; 108/147.13; 248/176.1; 280/47.28; 273/343; 206/579; 473/591

(58) Field of Classification Search

USPC ..... 211/13.1, 85.7, 49.1, 60.1, 70.6, 133.1, 211/133.3, 189, 194, 182, 188, 119.009, 30, 211/32, 33; 108/147.11–147.17; 248/122.1, 248/125.8, 158, 159, 440.1, 176.1; 280/47.19, 47.24, 47.28; 273/343, 407; 473/575, 476, 591, 415; 206/579, 206/315.1

See application file for complete search history.

(56) References Cited

U.S. PATENT DOCUMENTS

| | | | | | |
|---|---|---|---|---|---|
| 496,173 | A | * | 4/1893 | Smith | 211/75 |
| 516,347 | A | * | 3/1894 | Chamberlin | 211/175 |
| 541,216 | A | * | 6/1895 | Shanley | 312/210.5 |
| 594,433 | A | * | 11/1897 | Sheldon | 211/20 |
| 1,639,245 | A | * | 8/1927 | Westover | 211/13.1 |
| 1,701,951 | A | * | 2/1929 | Holt | 182/15 |
| 1,712,571 | A | * | 5/1929 | Levin | 211/1 |
| 1,865,862 | A | * | 7/1932 | Knepley | 168/22 |
| 2,010,093 | A | * | 8/1935 | Lazarus | 211/30 |
| 2,066,822 | A | * | 1/1937 | Cohen | 211/13.1 |
| 2,265,517 | A | | 12/1941 | Clement | |
| 2,336,686 | A | * | 12/1943 | Hudash | 211/33 |
| D137,325 | S | * | 2/1944 | Portis | D6/474 |
| 2,539,336 | A | * | 1/1951 | Sobers | 280/47.19 |
| D164,768 | S | * | 10/1951 | Fowler | D27/107 |
| D166,005 | S | * | 2/1952 | Summerhill | D34/26 |
| 2,590,154 | A | * | 3/1952 | Burns | 280/47.19 |
| D166,887 | S | * | 5/1952 | Spanel | D6/457 |
| D169,336 | S | * | 4/1953 | Reece | D34/21 |

(Continued)

*Primary Examiner* — Joshua J Michener

*Assistant Examiner* — Devin Barnett

(74) *Attorney, Agent, or Firm* — Thomas J. Oppold; Larkin Hoffman Daly & Lindgren, Ltd.

(57) ABSTRACT

A horseshoe game caddy for removably retaining horseshoes and stakes for playing a horseshoe game. The caddy includes a plurality of horseshoe racks supported by posts in vertically spaced relation. Each of the horseshoe racks are adapted to removably support at least one of the plurality of horseshoes.

36 Claims, 7 Drawing Sheets

(56) References Cited

U.S. PATENT DOCUMENTS

| | | | | | |
|---|---|---|---|---|---|
| 2,754,130 | A | * | 7/1956 | Procter | 280/47.23 |
| 2,896,789 | A | * | 7/1959 | Sans et al. | 108/28 |
| 3,147,988 | A | * | 9/1964 | Schairer | 280/47.19 |
| 3,517,824 | A | * | 6/1970 | Paque | 211/50 |
| 3,531,136 | A | * | 9/1970 | Mobley | 280/30 |
| 3,635,352 | A | * | 1/1972 | Brooks et al. | 211/47 |
| D250,866 | S | * | 1/1979 | Mulligan | D6/404 |
| 4,185,853 | A | * | 1/1980 | Thurmond, Jr. | 280/652 |
| 4,227,710 | A | * | 10/1980 | Laub | 280/47.19 |
| 4,281,843 | A | * | 8/1981 | Johnson et al. | 280/47.26 |
| D265,710 | S | * | 8/1982 | Stein | D7/634 |
| 4,367,819 | A | * | 1/1983 | Lewis | 211/59.1 |
| 4,407,521 | A | * | 10/1983 | Zeitlin | 280/655 |
| 4,494,658 | A | * | 1/1985 | Simon et al. | 211/49.1 |
| 4,620,637 | A | * | 11/1986 | Karashima | 211/188 |
| 4,898,281 | A | * | 2/1990 | Cherry | 211/13.1 |
| 4,927,159 | A | | 5/1990 | Morrissey et al. | |
| 4,940,150 | A | * | 7/1990 | Spengler | 211/188 |
| 5,026,089 | A | * | 6/1991 | Grimmonpre | 280/655 |
| 5,104,135 | A | * | 4/1992 | Sheets | 280/47.19 |
| 5,197,613 | A | * | 3/1993 | Kotlowski | 211/133.1 |
| 5,333,885 | A | * | 8/1994 | Pullman | 280/47.19 |
| 5,362,078 | A | * | 11/1994 | Paton | 280/47.18 |
| 5,370,242 | A | * | 12/1994 | Huang | 211/40 |
| D359,012 | S | * | 6/1995 | Gross | D11/132 |
| D378,799 | S | * | 4/1997 | Erickson | D8/401 |
| 5,743,416 | A | * | 4/1998 | Yemini | 211/70.6 |
| D393,970 | S | * | 5/1998 | Lee | D6/514 |
| 5,762,206 | A | * | 6/1998 | Leichter | 211/32 |
| 5,833,079 | A | * | 11/1998 | Roberts | 211/85.7 |
| 5,960,968 | A | * | 10/1999 | Wang | 211/187 |
| 5,979,675 | A | * | 11/1999 | Moriarty | 211/60.1 |
| 5,988,408 | A | * | 11/1999 | Evans et al. | 211/70.6 |
| 6,102,433 | A | * | 8/2000 | Stevens | 280/646 |
| 6,131,926 | A | * | 10/2000 | Harlan | 280/47.26 |
| 6,135,299 | A | * | 10/2000 | Burgess | 211/194 |
| 6,135,466 | A | * | 10/2000 | Irwin | 280/47.28 |
| 6,155,435 | A | * | 12/2000 | Malik | 211/41.12 |
| 6,158,360 | A | * | 12/2000 | Cheng | 108/103 |
| 6,213,295 | B1 | * | 4/2001 | Hohn | 206/315.1 |
| 6,220,610 | B1 | * | 4/2001 | Cox | 280/47.19 |
| 6,260,865 | B1 | * | 7/2001 | Yacobi et al. | 280/47.34 |
| 6,311,879 | B1 | * | 11/2001 | Rigler et al. | 223/84 |
| 6,390,309 | B1 | * | 5/2002 | Tucker | 211/85.7 |
| D459,044 | S | * | 6/2002 | Felsenthal | D32/66 |
| 6,425,490 | B1 | * | 7/2002 | Ta | 211/116 |
| 6,604,473 | B2 | * | 8/2003 | Felsenthal | 108/107 |
| D479,777 | S | * | 9/2003 | Sones | D6/404 |
| 6,616,152 | B2 | * | 9/2003 | Oliver | 280/47.18 |
| 6,695,156 | B1 | * | 2/2004 | Wang | 211/187 |
| D491,754 | S | * | 6/2004 | Harwanko | D6/479 |
| 6,808,185 | B1 | * | 10/2004 | Brace | 280/47.19 |
| 6,820,755 | B1 | * | 11/2004 | Ranjit | 211/70.6 |
| 6,889,982 | B1 | * | 5/2005 | Gove | 273/343 |
| 7,267,310 | B2 | * | 9/2007 | Welch et al. | 248/218.4 |
| 7,284,671 | B1 | * | 10/2007 | Doscher | 211/59.1 |
| 7,467,801 | B1 | * | 12/2008 | Garduno | 280/47.26 |
| D588,379 | S | * | 3/2009 | Chung | D6/479 |
| D589,281 | S | * | 3/2009 | Chung | D6/479 |
| D618,013 | S | * | 6/2010 | Corral | D6/450 |
| 7,726,656 | B1 | | 6/2010 | Kuchcinski et al. | |
| 7,857,328 | B1 | * | 12/2010 | Boss | 280/47.25 |
| 7,922,013 | B2 | * | 4/2011 | Nguy et al. | 211/70.6 |
| D638,190 | S | * | 5/2011 | Spann | D34/14 |
| 8,033,553 | B1 | * | 10/2011 | Feliciano et al. | 280/47.18 |
| 8,042,229 | B2 | * | 10/2011 | Wang | 16/270 |
| 8,262,106 | B1 | * | 9/2012 | Suszynsky | 280/47.131 |
| 8,286,564 | B2 | * | 10/2012 | Karl et al. | 108/107 |
| 8,333,160 | B2 | * | 12/2012 | Lin | 108/147.13 |
| 8,607,994 | B1 | * | 12/2013 | Schneider | 211/75 |
| D708,411 | S | * | 7/2014 | Schnautz | D34/14 |
| 2002/0073602 | A1 | * | 6/2002 | Neyman | 43/25.2 |
| 2002/0084588 | A1 | * | 7/2002 | Lynch | 273/343 |
| 2002/0113386 | A1 | * | 8/2002 | Be | 280/47.19 |
| 2003/0131767 | A1 | * | 7/2003 | Chen | 108/147.13 |
| 2004/0084880 | A1 | * | 5/2004 | Kim | 280/652 |
| 2004/0124160 | A1 | * | 7/2004 | Vitale | 211/40 |
| 2004/0130110 | A1 | * | 7/2004 | Stockler | 280/47.19 |
| 2004/0182810 | A1 | * | 9/2004 | Rosen | 211/181.1 |
| 2005/0056486 | A1 | * | 3/2005 | Butler et al. | 182/129 |
| 2005/0194338 | A1 | * | 9/2005 | Firth | 211/194 |
| 2006/0012139 | A1 | * | 1/2006 | Guirlinger | 280/35 |
| 2006/0145437 | A1 | * | 7/2006 | Odgers | 280/47.19 |
| 2007/0057476 | A1 | * | 3/2007 | Decky | 280/47.28 |
| 2008/0000854 | A1 | * | 1/2008 | Rief | 211/70.6 |
| 2008/0041799 | A1 | * | 2/2008 | Nguy et al. | 211/70.6 |
| 2008/0061020 | A1 | * | 3/2008 | Kaisler | 211/196 |
| 2008/0197131 | A1 | * | 8/2008 | Lin et al. | 220/23.83 |
| 2008/0251476 | A1 | * | 10/2008 | Shiao | 211/70.6 |
| 2009/0278316 | A1 | * | 11/2009 | LaMarte et al. | 273/343 |
| 2010/0288716 | A1 | * | 11/2010 | Northam et al. | 211/153 |
| 2011/0036278 | A1 | * | 2/2011 | Karl et al. | 108/147.13 |
| 2011/0036798 | A1 | * | 2/2011 | Chen | 211/188 |
| 2011/0117423 | A1 | * | 5/2011 | Kim | 429/176 |
| 2011/0117536 | A1 | * | 5/2011 | Zelachowski et al. | 434/365 |
| 2012/0175481 | A1 | * | 7/2012 | Disch | 248/316.4 |
| 2012/0181244 | A1 | * | 7/2012 | Wang | 211/106.01 |
| 2012/0261143 | A1 | * | 10/2012 | Craig et al. | 168/17 |
| 2012/0299259 | A1 | * | 11/2012 | Carlson et al. | 280/47.28 |
| 2013/0043664 | A1 | * | 2/2013 | Caldwell | 280/47.24 |

* cited by examiner

HORSESHOE GAME CADDY

BACKGROUND

The game of horseshoes typically includes two stakes and two sets of two horseshoes. To play the game, the two stakes are pounded into the ground a predetermined distance apart. One player stands behind one of the stakes and throws or "pitches" one pair of the horseshoes in succession toward the other stake, followed by the other player. There are different ways to play the game and different ways of scoring, but generally points are awarded to the player that throws a "ringer" and/or lands a horseshoe nearest to the stake.

There is a need for a caddy that may be used for carrying and storing set of horseshoe game components in a convenient manner which will keep all of the game components together.

DESCRIPTION

Figure 1:
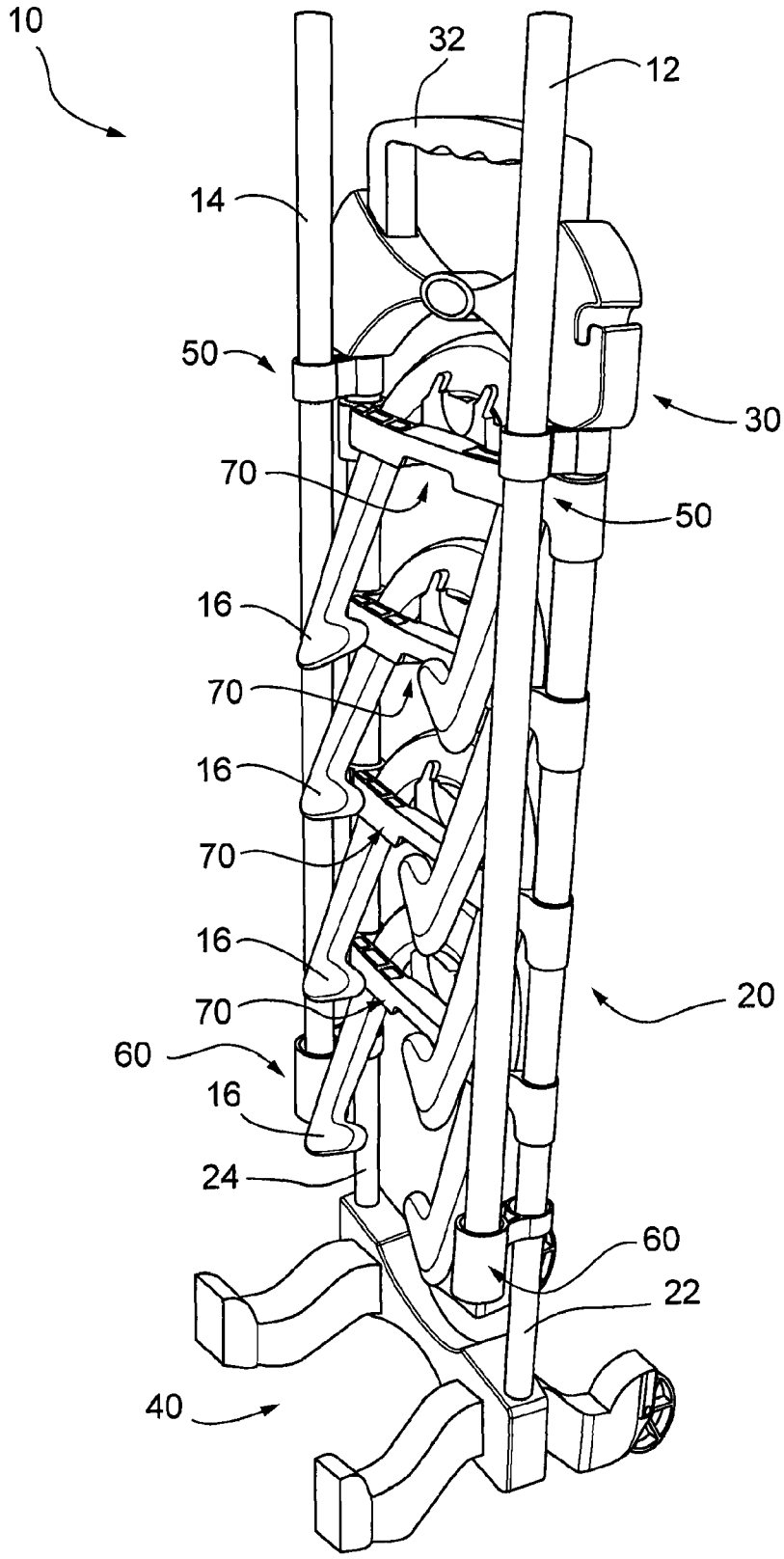
FIG. 1 is a front perspective view of one embodiment of a horseshoe game caddy holding a typical complete set of horseshoe game components.
Figure 2:
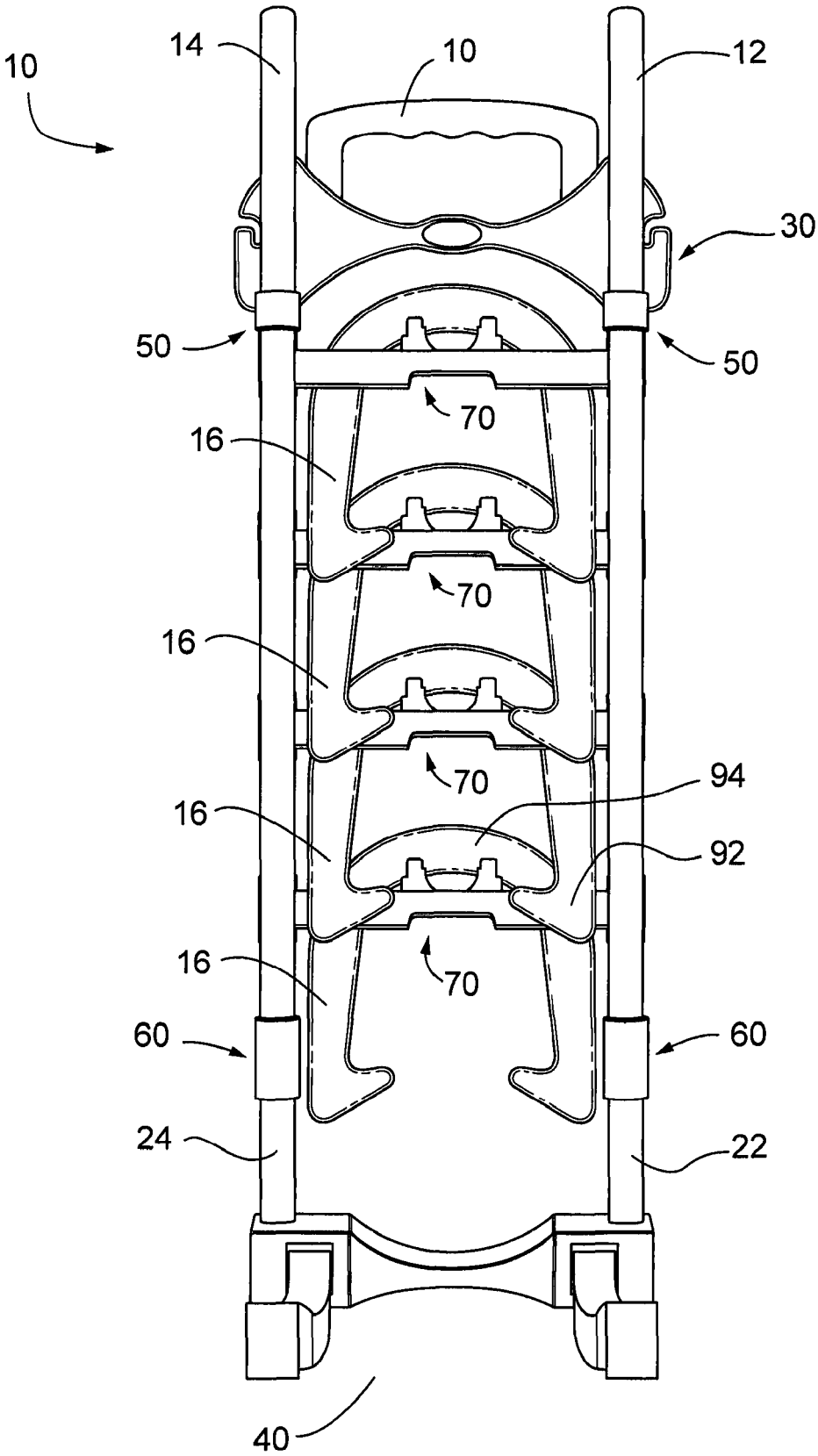
FIG. 2 is a front elevation view of the horseshoe caddy of FIG. 1.
Figure 3:
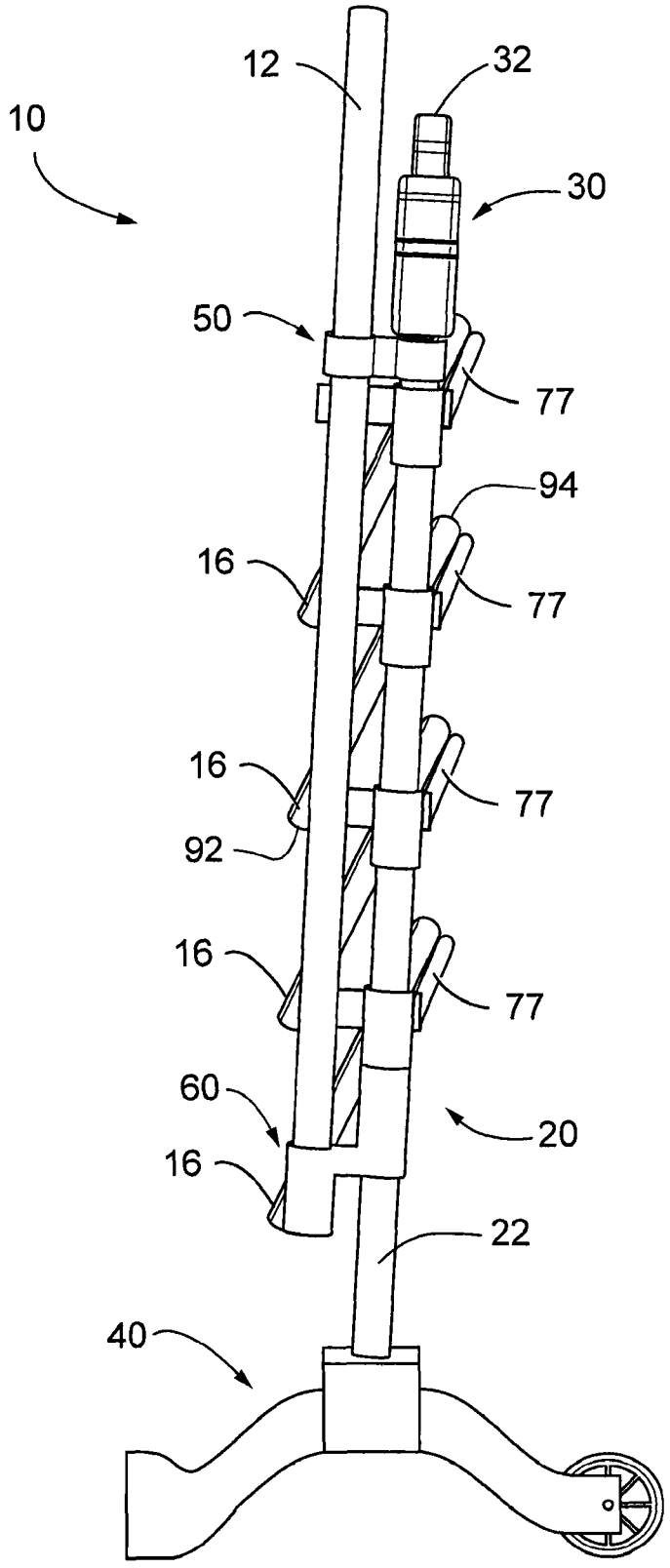
FIG. 3 is a right side elevation view of the horseshoe caddy of FIG. 1
Figure 4:
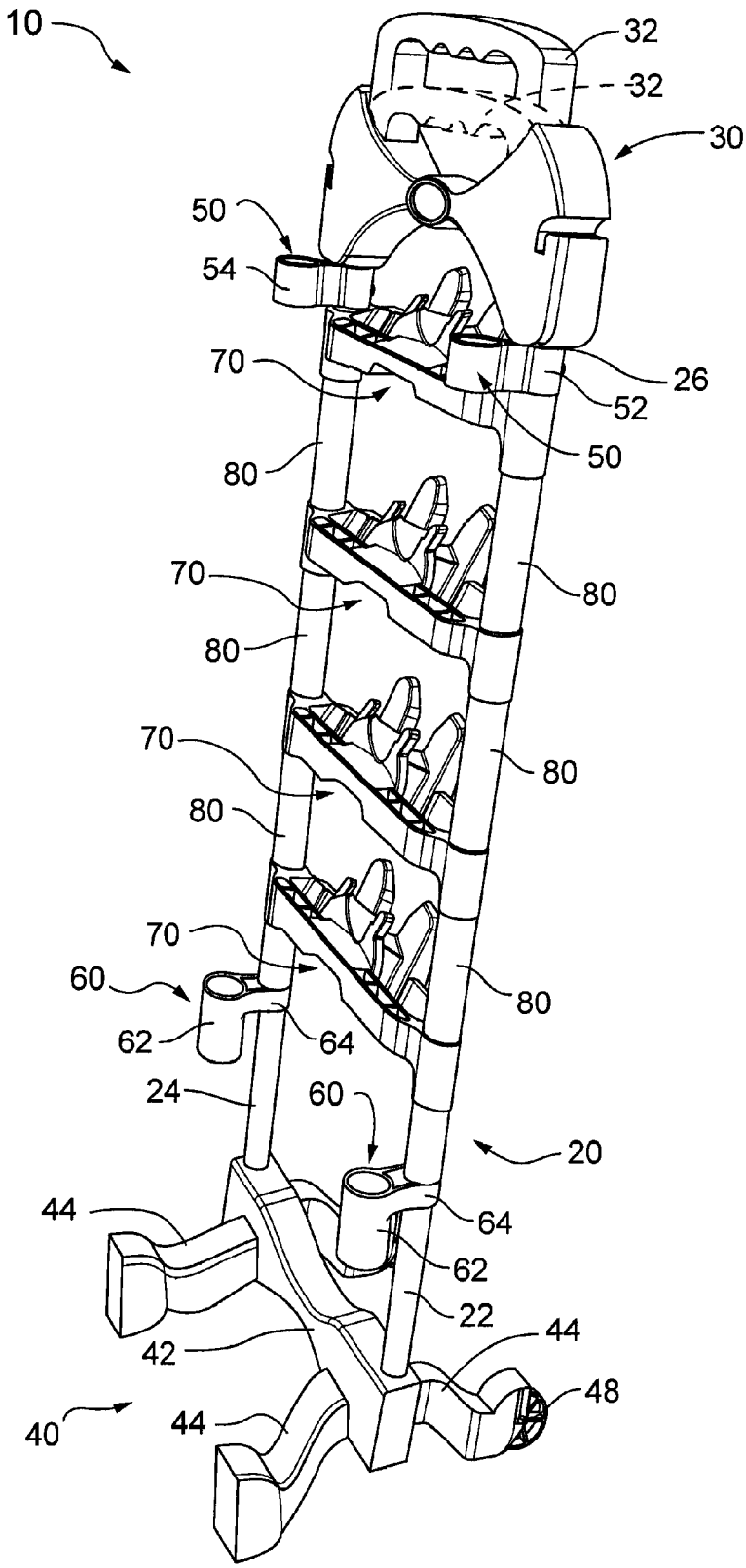
FIG. 4 is a front perspective view of the horseshoe caddy of FIG. 1 with the horseshoe game components removed.

Referring to the drawing figures, wherein like reference numerals designate the same or corresponding parts throughout the several views, FIG. 1 is a perspective view of one embodiment of a horseshoe caddy 10. In FIG. 1, the horseshoe caddy 10 is shown holding the horseshoe game components, which typically includes two stakes 12, 14 and four horseshoes 16 (i.e., two pairs of two horseshoes). FIG. 2 is a front elevation view of the caddy 10 of FIG. 1, and FIG. 3 is a left side elevation view of FIG. 1. FIG. 4 is the same perspective view of the horseshoe caddy of FIG. 1, but with the stakes and horseshoes removed for clarity to better view the elements of the caddy 10.

Figure 5:
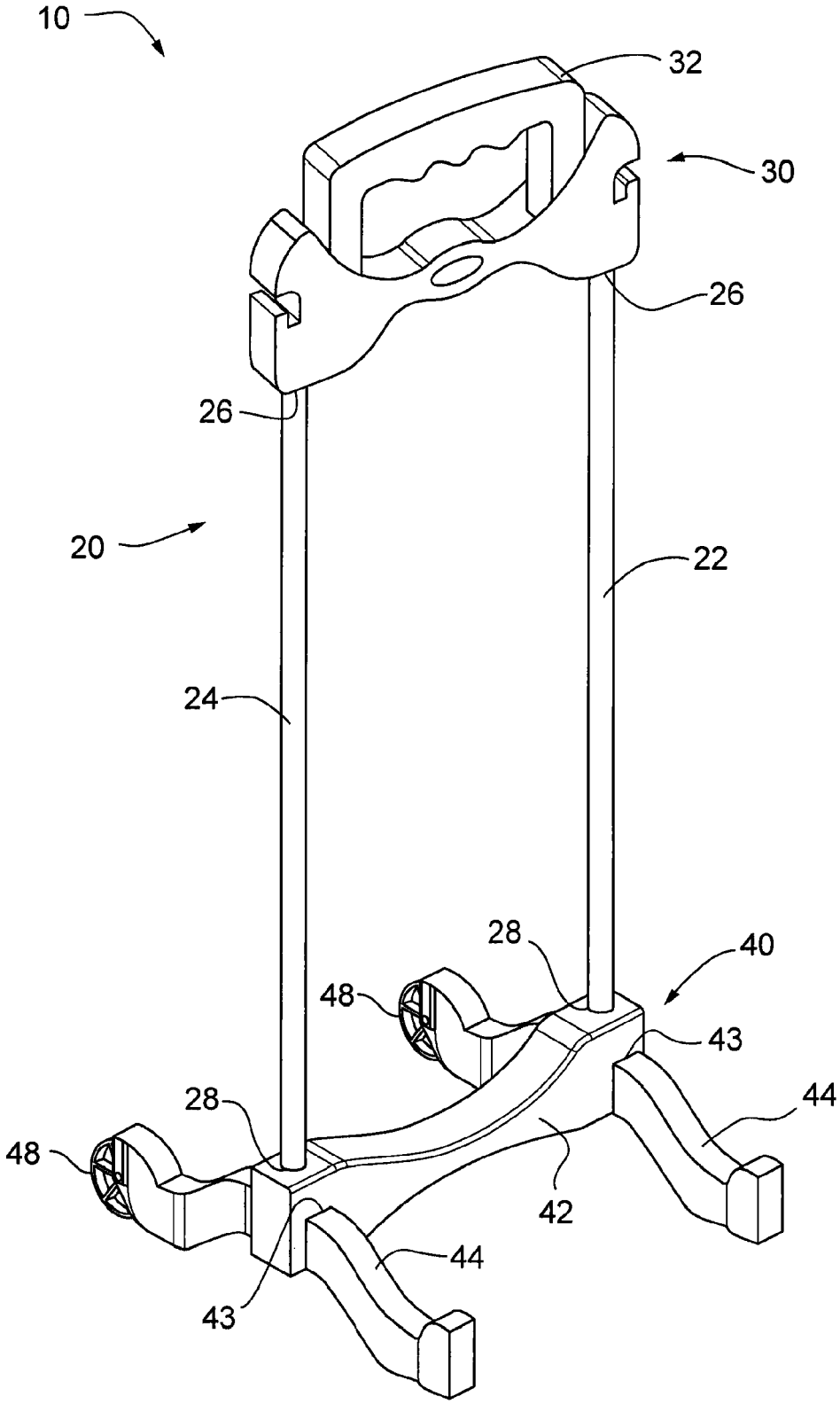
FIG. 5 is a perspective view of the frame of the horseshoe caddy of FIG. 1.

Referring to FIG. 5, the caddy 10 comprises a main frame 20 which includes two substantially parallel posts 22, 24, a handle support 30 and a base 40. Comparing FIGS. 4 and 5, and as described in more detail below, it can be seen that the posts 22, 24 operably support upper and lower stake holders 50, 60 between which are disposed a plurality of horseshoe racks 70 which are spaced vertically along the posts 22, 24 by intermediate spacers 80.

The posts 22, 24 are constructed of material that is sufficiently rigid to support the weight of the game components during transport, but yet are preferably lightweight to minimize the overall weight of the caddy 10 to reduce shipping costs and so that it is more easily transportable by players of all ages. For example, the posts 22, 24 may be constructed of thin walled hollow metal tubing or other sufficiently rigid, lightweight material of a desired cross-sectional configuration. The posts 22, 24 are received within bores 26 disposed on the underside of the handle support 30 and bores 28 disposed on the top side of the base 40. The posts 22, 24 may be retained in the bores 26, 28 by tapping screws (not shown).

The handle support 30 serves as a lateral brace for the upper end of the frame 20 and may be constructed of any suitably rigid and preferably lightweight material such as thermoformed plastic or other desirable material. The handle support 30 includes a handle grip 32 which may be telescopically received within the handle support 30 such that the handle grip 32 may move between an upwardly extended position and a downwardly collapsed position (as shown in dashed lines in FIG. 4). In the upwardly extended position, the handle grip 32 is sufficiently raised to an elevation that avoids or reduces the need for a player to bend over or lean when pulling the caddy 10. The downwardly collapsed position provides the advantage of permitting the caddy 10 to be shipped in a shorter box than if the handle was fixed in the fully extended position. Thus, while a telescoping handle as embodied herein provides ergonomic advantages while pulling the caddy and the advantage of being able to ship the caddy in a shorter box, it should be appreciated that the handle grip 32 need not be telescoping and may be fixedly attached or formed integral with the handle support 30.

Figure 6:
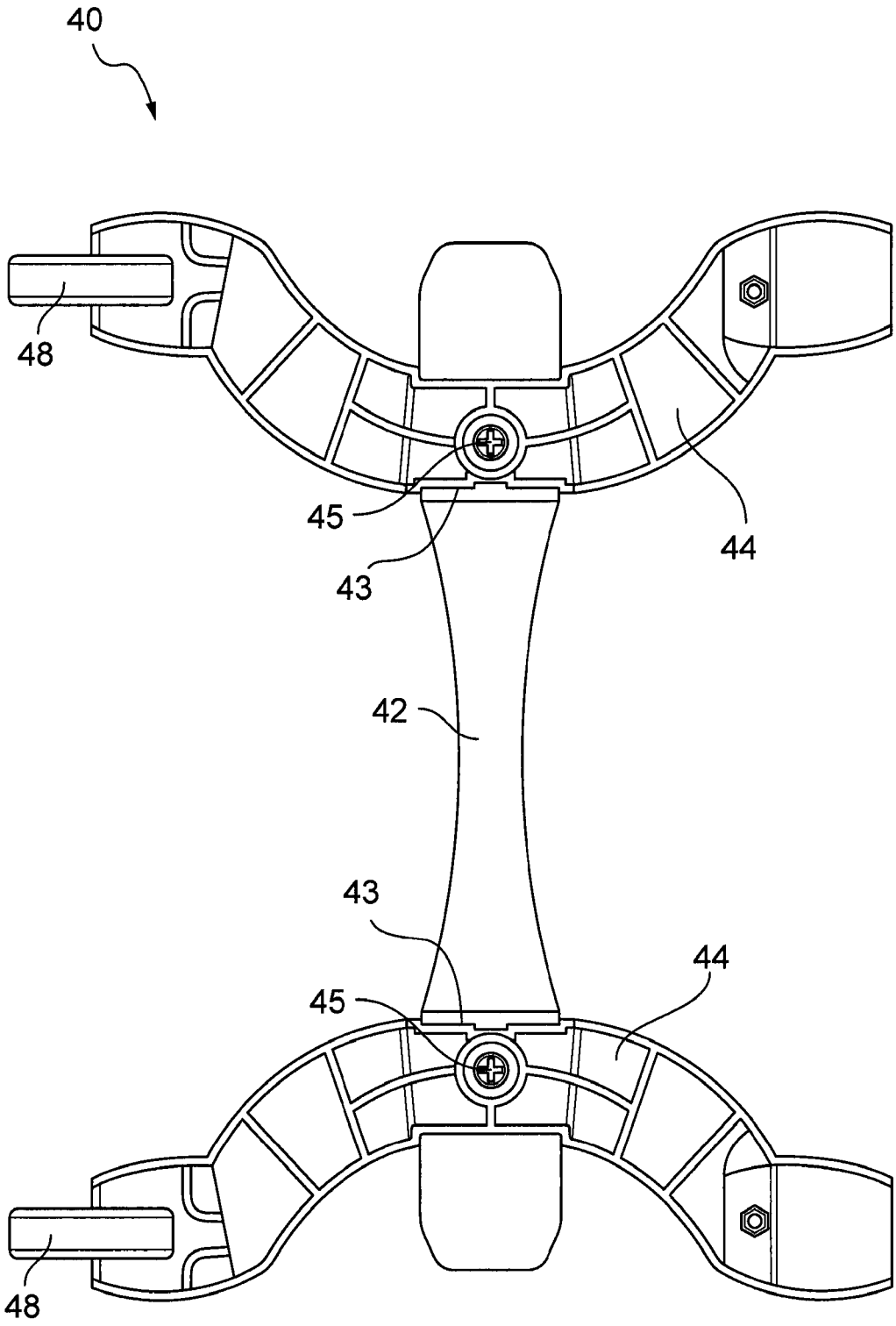
FIG. 6 is a bottom plan view of one embodiment of the base of the frame of FIG. 5.

The base 40 includes a laterally extending cross-member 42 and a pair of fore and aft extending legs 44 secured to the underside of the cross-member 42 to stabilize and support the caddy in an upright position such that it does not easily tip over. As identified in FIGS. 5 and 6, the cross-member 42 includes recesses 43 into which the legs 44 are received and secured in place by a threaded connector 45 (FIG. 6). Alternatively, the legs 44 and the lateral brace 42 may be molded or otherwise formed as a unitary member. One end of the legs 44 support rollers or wheels 48 or alternatively one end of the legs 44 may support a wheeled axle extending between the legs so that the caddy may be pulled behind a player as he or she walks so the player does not need to lift and carry the caddy 10 which, when fully loaded with a complete set of horseshoe game components, can be quite heavy for younger players.

As viewed in FIGS. 1-4, at the upper and lower ends of the posts 22, 24 are secured the upper and lower stake holders 50, 60, respectively. Each of the upper stake holders 50 comprise an upper post sleeve 52 through which the upper ends of the posts 22, 24 are received. Tapping screws may be used to secure the upper post sleeves 52 to the posts 22, 24. A short tubular section 54 is spaced forwardly of the upper post sleeves 52 through which the bottom ends of the stakes 12, 14 are inserted. The bottom ends of the stakes 12, 14 are retained and supported by the lower stake holders 60 each of which comprises a closed ended tubular section 62 spaced forwardly of the lower post sleeves 64 through which the lower ends of the posts 22, 24 are received. Similar to the upper stake holders 50, the lower stake holders 60 may be secured to the posts 22, 24 by tapping screws (not shown).

Figure 7:
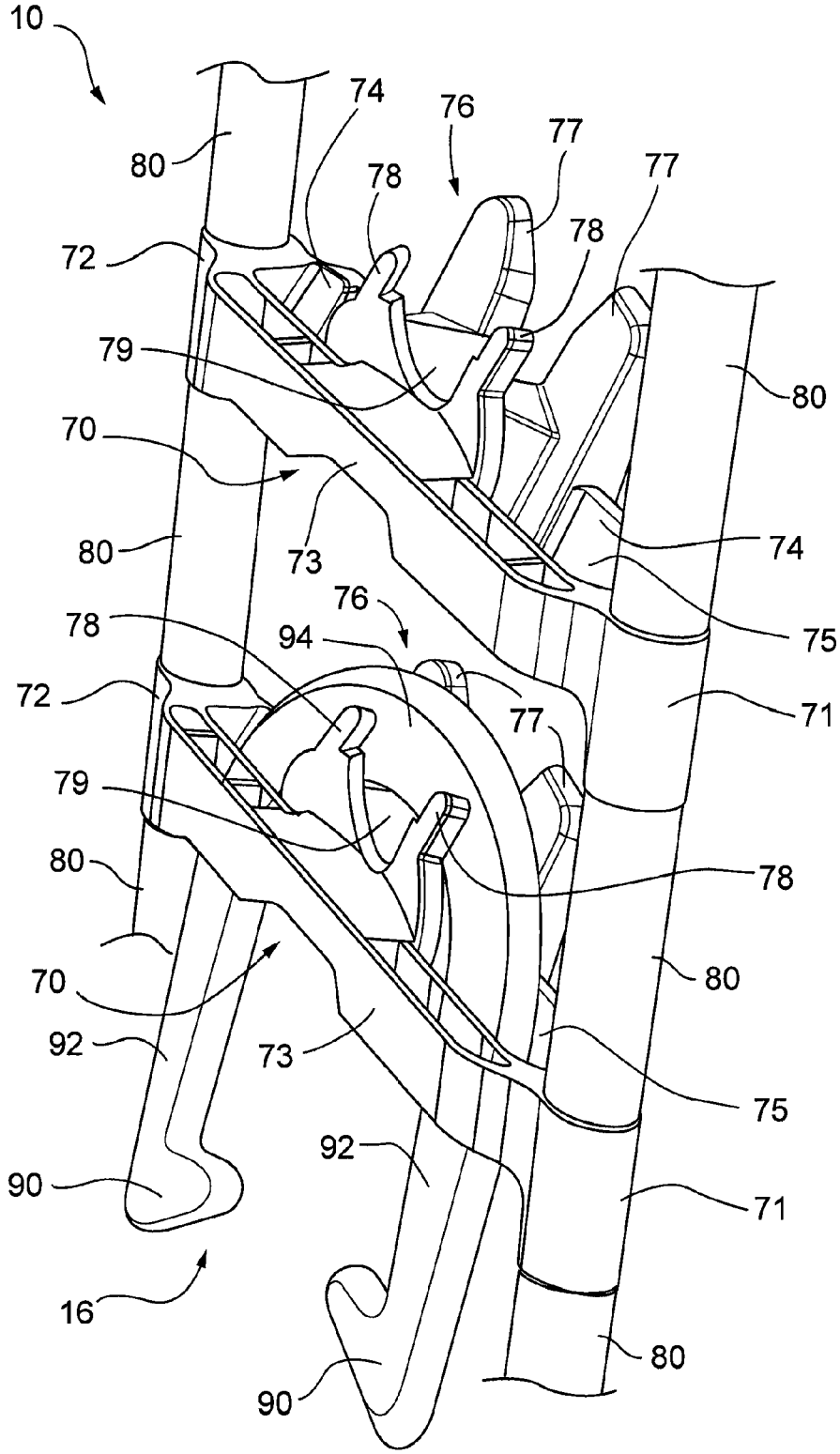
FIG. 7 is an enlarged perspective view of the horseshoe rack portions of the horseshoe caddy of FIG. 1 with one of the horseshoes removed to show an embodiment of the saddle.

Disposed between the upper and lower stake holders 50, 60 are a plurality of horseshoe racks 70 which are supported in spaced relation on the posts 22, 24 by spacers 80, comprising tubular sleeves through which the posts 22, 24 extend. As best viewed in FIG. 7, each of the horeseshoe racks 70 comprise a pair of tubular sleeves 71, 72 through which the posts 22, 24 extend. Laterally bridging between the two sleeves 71, 72 are front and rear crossbeams 73, 74 spaced fore and aft a sufficient distance to create a gap 75 between which the heel ends 90 and branches 92 of the horseshoe 16 will pass through. The opposing inside faces of the front and rear crossbeams 73, 74 have a rearwardly angled slope. A saddle 76 is positioned in the middle of the crossbeams 73, 74 to support the toe portion 94 of the horseshoe 16. The back side of the saddle 76 includes upwardly extending, rearwardly sloping ears 77 against which the back side of the toe portion of the horseshoe will rest. The front side of the saddle 76 includes upwardly extending rearwardly sloping retainer clips 78. The toe portion 94 of the horseshoe is thereby frictionally retained between the upwardly extending ears 77 and the upwardly extending retainer clips 78. The saddle 76 includes a recess 79 between the ears 77 and clips 78 so that the player can insert a finger under the toe portion 94 of the horseshoe 16 from the back side of the caddy and thereby lift the horseshoe up and out of the horseshoe rack 70.

As illustrated in FIGS. 1-3, when the horseshoes 16 are retained in the horseshoe racks, the horseshoes are arranged in an overlapping, vertically stacked relation wherein the heel ends 90 of the upper horseshoes 16 overlap or extend below the toe portion 94 of the next lower horseshoe 16. Furthermore, due to the rearwardly sloping inside opposing faces of the front and rear crossbeams 73, 74 and the rearwardly sloping, upwardly extending ears 77 and retainer clips 78, the horseshoes are retained within the horseshoe racks 70 at an angle with respect to the posts 22, 24 such that the toe portion 94 of the horseshoes are rearward of the posts 22,24 and the heel ends 90 are forward of the posts 22, 24.

It should be appreciated that with the horseshoes 16 positioned in this manner, and the stakes 12, 14 positioned on the front side of the slightly rearwardly leaning posts 22, 24, the center of gravity of the mass of the comparatively heavy game compents are substantially aligned with the center of the base 40, thereby promoting fore and aft stability of the caddy 10. Whereas if all of the mass of the comparatively heavy game componets were all on one side or the other of the posts 22, 24 or on one side of the centerline of the base 40, the caddy would be much more susceptible to tipping. Furthermore, by being so arranged, it should be appreciated that the individual horseshoes 16 and the stakes 12, 14 are easily removable from the caddy 10 one at a time, and in any order, without significantly affecting the fore and aft stability of the caddy.

Various modifications to the embodiments of the apparatus, and the general principles and features of the embodiments described herein will be readily apparent to those of skill in the art. Thus, the present invention is not to be limited to the embodiments described above and illustrated in the drawing figures, but is to be accorded the widest scope consistent with the spirit and scope of the appended claims.

The invention claimed is:

1. A horseshoe game caddy in combination with a plurality of horseshoes for playing a horseshoe game, the caddy comprising:

a frame having laterally spaced posts and a base;

a plurality of horseshoe racks supported by said posts in vertically spaced relation, each of said horseshoe racks supporting at least one of the plurality of horseshoes in a manner whereby a heel end of an upper one of the plurality of horseshoes overlaps a toe portion of a lower adjacent one of the plurality of horseshoes.

2. The horseshoe game caddy of claim 1 wherein the plurality of horseshoes are supported at an angle with respect to the posts.

3. The horseshoe game caddy of claim 1 wherein said posts are disposed at an angle with respect to said base.

4. The horseshoe game caddy of claim 1 further comprising upper and lower stake holders adapted to removably support stakes for playing the horseshoe game.

5. The horseshoe game caddy of claim 1, wherein said base includes legs extending outwardly in a direction transverse to said base.

6. The horseshoe game caddy of claim 5 wherein said legs include wheels such that the caddy is rollable.

7. The horseshoe game caddy of claim 6, wherein said base is disposed in a lateral direction and said legs extend in a fore and aft direction with respect to said laterally disposed base such that when the caddy is rolled in said fore or aft direction said base is substantially transverse to said fore or aft direction of rolling.

8. The horseshoe game caddy of claim 1, further comprising a handle grip.

9. The horseshoe game caddy of claim 8, wherein said handle grip is movable between an upwardly extended position and lower collapsed position.

10. A horseshoe game caddy in combination with a plurality of horseshoes for playing a horseshoe game, the caddy comprising:

a frame having laterally spaced posts and a base;

a plurality of horseshoe racks supported by said posts in vertically spaced relation, each of said horseshoe racks supporting at least one of the plurality of horseshoes and wherein the plurality of horseshoes are supported at an angle with respect to said posts.

11. The horseshoe game caddy of claim 10 wherein a heel end of an upper one of the plurality of horseshoes overlaps a toe portion of a lower adjacent one of the plurality of horseshoes.

12. The horseshoe game caddy of claim 10 wherein said posts are disposed at an angle with respect to said base.

13. The horseshoe game caddy of claim 10 further comprising upper and lower stake holders adapted to removably support stakes for playing the horseshoe game.

14. The horseshoe game caddy of claim 10, wherein said base includes legs extending outwardly in a direction transverse to said base.

15. The horseshoe game caddy of claim 14 wherein said legs include wheels such that the caddy is rollable.

16. The horseshoe game caddy of claim 15, wherein said base is disposed in a lateral direction and said legs extend in a fore and aft direction with respect to said laterally disposed base such that when the caddy is rolled in said fore or aft direction said base is substantially transverse to said fore or aft direction of rolling.

17. The horseshoe game caddy of claim 10, further comprising a handle grip.

18. The horseshoe game caddy of claim 17, wherein said handle grip is movable between an upwardly extended position and lower collapsed position.

19. A horseshoe game caddy in combination with a plurality of horseshoes for playing a horseshoe game, the caddy comprising:

a frame having laterally spaced posts and a base;

a plurality of horseshoe racks supported by said posts in vertically spaced relation, each of said horseshoe racks supporting at least one of the plurality of horseshoes and wherein a toe portion of each of the plurality of horseshoes is disposed on one side of the posts and a heel end of each of the plurality of horseshoes is disposed on another side of the posts.

20. The horseshoe game caddy of claim 19 wherein said heel end of an upper one of the plurality of horseshoes overlaps said toe portion of a lower adjacent one of the plurality of horseshoes.

21. The horseshoe game caddy of claim 19 wherein the plurality of horseshoes are supported at an angle with respect to said posts.

22. The horseshoe game caddy of claim 19 wherein said posts are disposed at an angle with respect to said base.

23. The horseshoe game caddy of claim 19 further comprising upper and lower stake holders adapted to removably support stakes for playing the horseshoe game.

24. The horseshoe game caddy of claim 19, wherein said base includes legs extending outwardly in a direction transverse to said base.

25. The horseshoe game caddy of claim 24 wherein said legs include wheels such that the caddy is rollable.

26. The horseshoe game caddy of claim 25, wherein said base is disposed in a lateral direction and said legs extend in a fore and aft direction with respect to said laterally disposed base such that when the caddy is rolled in said fore or aft direction said base is substantially transverse to said fore or aft direction of rolling.

27. The horseshoe game caddy of claim 19, further comprising a handle grip.

28. The horseshoe game caddy of claim 27, wherein said handle grip is movable between an upwardly extended position and lower collapsed position.

29. A horseshoe game caddy in combination with a plurality of horseshoes for playing a horseshoe game, the caddy comprising:

a frame having laterally spaced posts and a base, said posts disposed at an angle with respect to said base;

stake holders removably receiving the stakes;

a plurality of horseshoe racks supported by said posts in vertically spaced relation, each of said horseshoe racks removably receiving at least one of the plurality of horseshoes;

whereby a center of gravity of the plurality horseshoes and the stakes is substantially aligned with said base when the stakes are received by the stake holders and the plurality of horseshoes are received by the plurality of horseshoe racks.

30. The horseshoe game caddy of claim 29 wherein said heel end of an upper one of the plurality of horseshoes overlaps said toe portion of a lower adjacent one of the plurality of horseshoes.

31. The horseshoe game caddy of claim 29 wherein the plurality of horseshoes are supported at an angle with respect to said posts.

32. The horseshoe game caddy of claim 29, wherein said base includes legs extending outwardly in a direction transverse to said base.

33. The horseshoe game caddy of claim 32 wherein said legs include wheels such that the caddy is rollable.

34. The horseshoe game caddy of claim 33, wherein said base is disposed in a lateral direction and said legs extend in a fore and aft direction with respect to said laterally disposed base such that when the caddy is rolled in said fore or aft direction said base is substantially transverse to said fore or aft direction of rolling.

35. The horseshoe game caddy of claim 29, further comprising a handle grip.

36. The horseshoe game caddy of claim 35, wherein said handle grip is movable between an upwardly extended position and lower collapsed position.

* * * * *